United States Patent [19]

Sze

[11] 3,988,883

[45] Nov. 2, 1976

[54] STRETCH-RESISTANT BULKED YARN

[75] Inventor: Benjamin Chiatse Sze, Wilmington, Del.

[73] Assignee: E. I. DuPont de Nemours and Company, Wilmington, Del.

[22] Filed: Aug. 14, 1963

[21] Appl. No.: 303,214

Related U.S. Application Data

[63] Continuation-in-part of Ser. No. 651,018, April 5, 1957, abandoned.

[52] U.S. Cl. ..... 57/140 BY; 28/72 HR; 28/72.17

[51] Int. Cl.[2] ..... D02G 3/04; D02J 1/22

[58] Field of Search ..... 57/140, 140 I, 140 BL, 57/157; 28/72 F, 72 HR, 72.17; 161/172, 175

[56] References Cited

UNITED STATES PATENTS

| | | | |
|---|---|---|---|
| 2,369,395 | 2/1945 | Heymann | 57/140 BL |
| 2,386,173 | 10/1945 | Kulp et al. | 425/463 |
| 2,461,094 | 2/1949 | Taylor | 57/140 BL |
| 2,931,091 | 4/1960 | Breen | 428/370 |

*Primary Examiner*—Louis K. Rimrodt

[57] ABSTRACT

A bulked dimensionally stable yarn composed of a plurality of crimped and straight filaments randomly disposed throughout the cross-section of the yarn, said crimped filaments provide bulk and said straight filaments provide dimensional stability.

10 Claims, 10 Drawing Figures

INVENTOR

BENJAMIN CHIATSE SZE

BY Carl A. Hechmer

ATTORNEY

INVENTOR

BENJAMIN CHIATSE SZE

BY Carl A. Hechner

ATTORNEY

Fig. 9
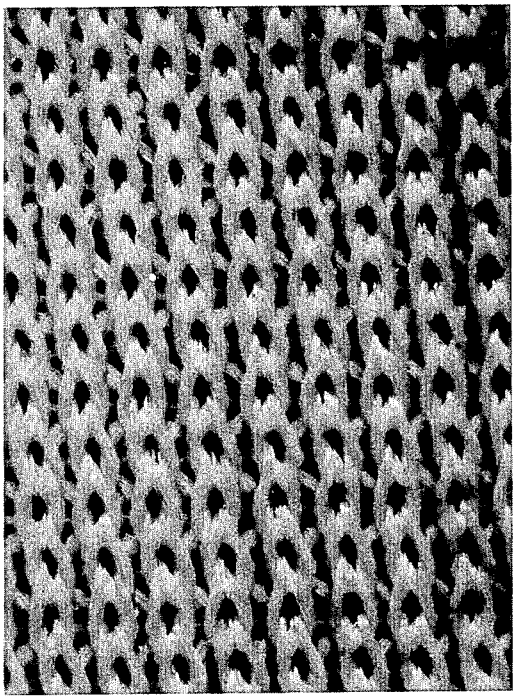
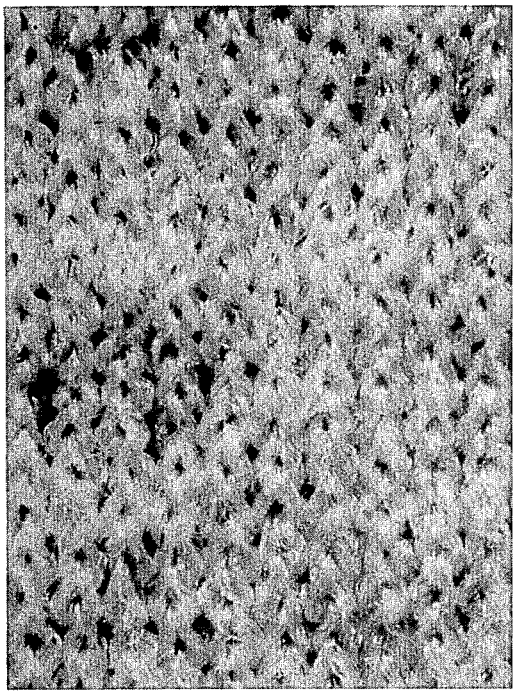
Fig. 10
INVENTOR
BENJAMIN CHIATSE SZE
BY Carl A. Hechmer
ATTORNEY

STRETCH-RESISTANT BULKED YARN

This application is a continuation-in-part of my copending application Ser. No. 651,018, filed Apr. 5, 1957, and now abandoned.

This invention relates to a novel article of commerce. More specifically, it is concerned with a novel and useful bulky continuous filament yarn and fabric produced from the said yarn.

Investigators in the textile field have long been concerned with obtaining voluminous strands of continuous filaments with properties similar to those yarns obtained from natural staple fibers. Production of natural staple fiber yarns is expensive and requires a complex series of operations to align the fibers, combine them into an elongated band and draw the bundle to smaller diameter while twisting to prevent excessive slippage of adjacent fibers past each other. Further operations are required to produce a yarn or thread useful for textile purposes. The relatively large deniers of such yarns restricts their use in such fields as that of tricot knitting for example.

Most synthetic fibers are produced most easily as continuous filaments. Strands of continuous filaments can be made much easier than spun yarns for staple fibers. The continuous filament yarn can be made very strong because of the absence of loose ends found in staple yarn that are unable to transmit imposed stresses. However, due to the lack of loose ends and the extreme uniformity of cross-section and longitudinal sections, conventional continuous filament yarns are much denser than their staple counterparts. The filaments lie in a close parallel relationship in the yarn, and adjacent strands of continuous filament yarns in fabrics are closely spaced. This compactness limits the amount of insulating air space present, reduces the visual covering power of a given weight of fabric, and affords the fabrics or knit wear a hard slick handle typical of synthetic filaments.

It is an object of the present invention to provide a bulky continuous filament yarn.

Another object is to produce a yarn from which non-elastic fabric may be produced in a conventional manner but wherein one component of the yarn is crimpable after the said fabric is produced.

Another object is to produce a non-elastic fabric from crimpable yarn which fabric possesses a high bulk and high covering power.

These and other objects are accomplished by providing a yarn consisting of a self-crimpable or composite member having at least two continuous polymeric components in adhering contact and a stress-bearing, single-component filament. Such yarn is useful in the production of a non-elastic fabric by conventional means, which fabric may thereafter be increased in bulk and covering power by relaxation of the yarn to induce crimp in the crimpable component. The self-crimpable (composite) yarn component may be a "sheath-core filament" wherein the core of the one man-made synthetic material is sheathed within the covering of a second man-made polymer, the two polymeric components differing in their shrinkage characteristics. Because of the difference in shrinkage characteristics of the polymer components of the sheath-core filament, relaxation of such filament causes it to curl helically in a regular or irregular fashion, depending upon the nature of the polymers and the extent of relaxation, and the like. Similarly, the composite, self-crimpable filament may consist of two or more components adhered together in side-by-side relationship, the components differing in shrinkage characteristics. The single-component filament of the mixed yarn bundle is a highly shrinkable filament of a man-made polymer, i.e., a polymer produced by addition or condensation from relatively low molecular weight reactants and having a relatively high potential residual shrinkage, preferably at least about 15%.

While the yarn bundle described above may be prepared by blending a single component yarn with a sheath-core yarn, the mixture may be more conveniently produced by the filament forming extrusion assembly, as illustrated herein, which comprises a spinneret plate containing a multiplicity of apertures, a second plate containing apertures coaxially aligned with some of the apertures in the said spinneret plate and a radially feeding channel between the coaxially aligned apertures in combination with a supply means for a filament forming liquid disposed to feed the apertures of the spinneret plate and an independent supply means for a second filament forming liquid to feed the coaxially aligned apertures. The radially feeding channel is conveniently formed by a relatively restricted clearance between the surface of the spinneret plate adjacent to the ingress orifices of its coaxially aligned apertures and the surface of the second plate adjacent to the egress orifices of the coaxially aligned apertures of the said second plate. It is convenient to form the radial feeding channel by a metering land between the spinneret plate and the second plate, which land may protrude from the ingress orifice of the spinneret plate or the egress orifice of the second plate. Such arrangement permits a controlled difference in flow volume of filament forming fluid to those apertures in the spinneret plate which are coaxially aligned with apertures in the second plate and those apertures in the spinneret plate not so aligned.

The invention will be more readily understood by reference to the accompanying drawings, in which:

FIG. 9 is an enlarged photograph of a tricot knit fabric of continuous nylon filament; and FIG.10 is an enlarged photograph of a tricot knit fabric of the present invention after relaxing.

Figure 1:
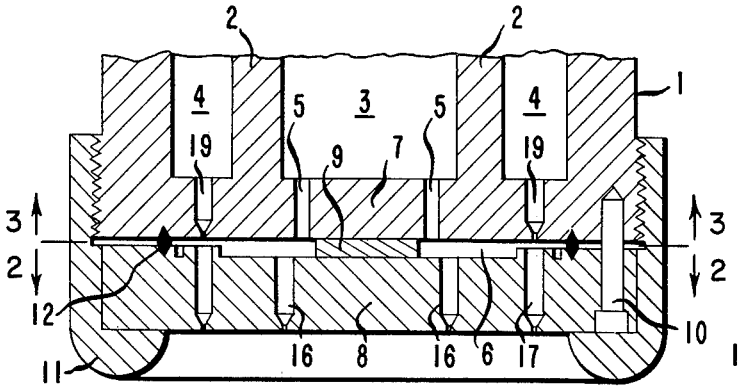
FIG. 1 is a sectional elevation of the extrusion assembly of the present invention.

As will be apparent from FIG. 1, the spinneret assembly of the present invention comprises a cylindrical housng 1 partitioned by means of concentric circular hollow section 2 into an inner cistern 3 and an outer cistern 4. Cistern 3 feeds by means of straight bores 5 into reservoir 6, the said reservoir being formed between the discharge surface of housing face 7 and the inlet surface of spinneret plate 8 at a clearance determined by spacing shim 9, the spinneret plate being aligned with the housing by means of aligning pin 10 and secured in position by means of threaded retaining collar 11. Annular gasket 12 seated in grooves in the housing face 7 and in the peripheral annular raised abutment of the spinneret plate 8, forms the outer periphery of the said reservoir. Apertures in spinneret plate 8 are straight bores tapering to capillaries at the extrusion or outer face of the said plate. The said apertures include those essentially axially fed 16 by reservoir 6 and those essentially radially fed 17, due to the restricted flow between the discharge surface of housing face 7 and the metering lands or plateaus around the inlet orifices of apertures 17. In addition to radial flow from reservoir 6, apertures 17 are fed axially from outer cistern 4 by means of apertures 19 in housing face 7. Apertures 19 are straight bores tapering to capillaries at the discharge surface of the said housing face, the said capillaries being coaxially centered on the inlet orifices of apertures 17. Thus, in operation, apertures 16 extrude liquid from inner cistern 3 while apertures 17 extrude liquid from both inner cistern 3 and outer cistern 4.

Figure 2:
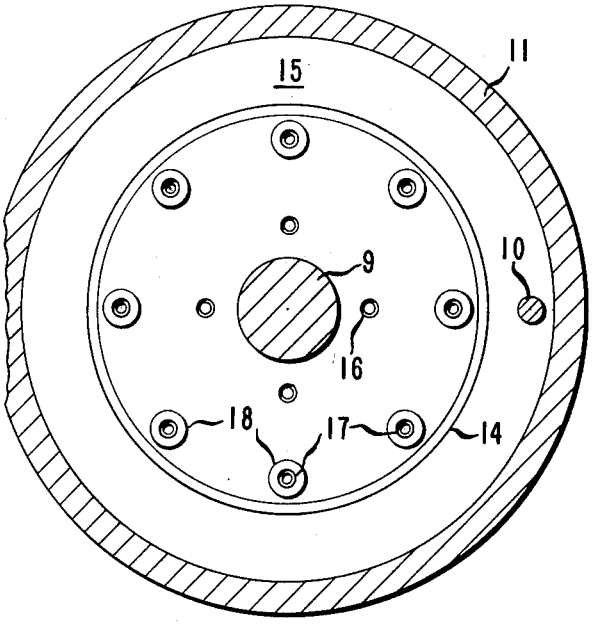
FIG. 2 is a plan view of a section through lines 2—2 of FIG. 1.

FIG. 2 is a section taken through lines 2—2 of FIG. 1 As shown in the figure, apertures 16 are conventiently circularly disposed in the spinneret face concentrically within similarly disposed apertures 17, the latter apertures having metering lands 18 as shown. Circular spacing shim 9 is at the center of the structure. Annular abutment 15 around the edge of spinneret plate 8 is grooved at 14 to seat annular gasket 12. The aligning pin is shown at 10 and the retaining collar at 11.

Figure 3:
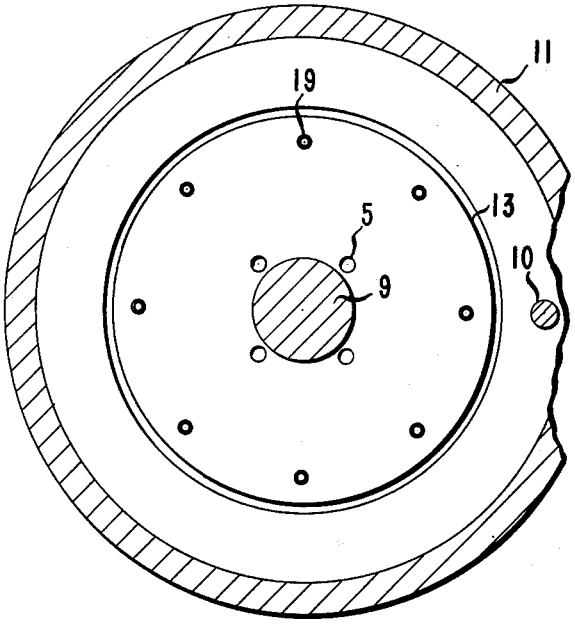
FIG. 3 is a plan view taken through lines 3—3 of FIG. 1.

A section through lines 3—3 of FIG. 1 is shown at FIG. 3 and illustrates the structure of the discharge surface of housing face 7. Circularly arranged straight bores 5 are disposed concentrically within similarly disposed apertures 19. Annular groove 13 provides seating in the housing face for gasket 12.

Figure 4:
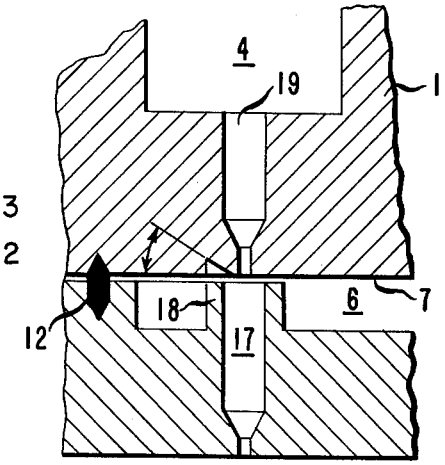
FIGS. 4 and 5 are detailed fragmentary sections of modifications of the metering lands, as identified hereinafter, of FIG. 1.

FIG. 4 shows a modification wherein the housing face is annularly notched to increase the clearance between one side of metering lands 18 and the discharge surface of housing face 7. In the embodiment illustrated the notch follows the outer edges of the capillaries of apertures 19. Such an arrangement increases radial liquid feed flow from reservoir 6 to apertures 17.

Figure 5:
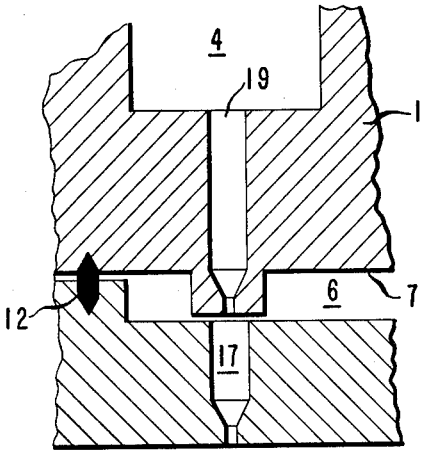

In FIG. 5 the metering land extends from housing face 7 around aperture 19. The relatively close clearance in the vicinity of the inlet orifice of aperture 17 causes the metered flow from reservoir 6 to approach radially.

Figure 6:
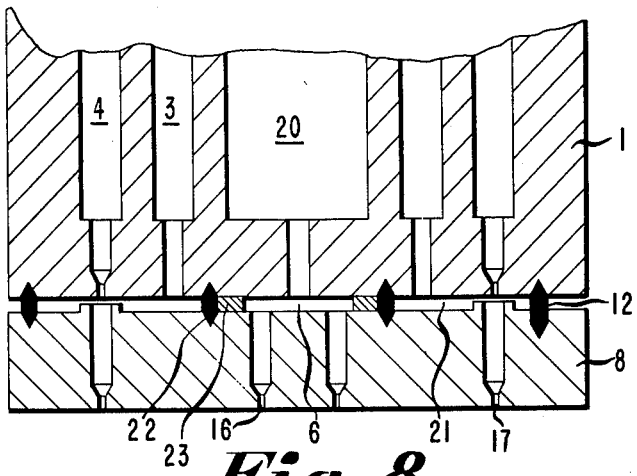
FIG. 6 is a diagrammatic illustration of a modification of the filament-forming extrusion assembly of the present invention.

FIG. 6 is a further modification wherein three concentric cisterns 4, 3 and 20 and two reservoirs 6 and 21 are provided using two annular gaskets 12 and 22 and an annular spacing shim 23.

Figure 7:
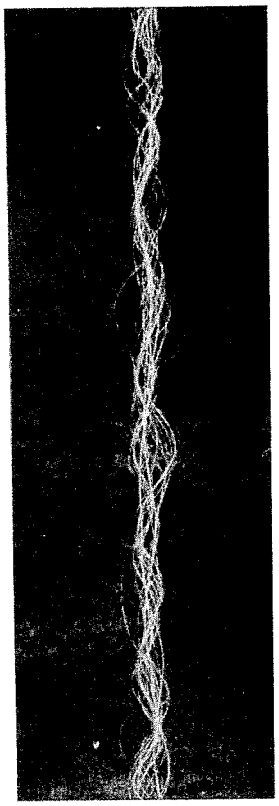
FIG. 7 is an enlarged photograph of the preferred relaxed yarn of the present invention wherein the simple filaments and sheath-core filaments of the yarn bundle are extruded simultaneously, employing the filament-forming assembly of the present invention.

FIG. 7 is a relaxed yarn of mixed simple and sheath-core filaments produced by the simultaneous forming of each component using the filament-forming assembly of the present invention. Preferably the relaxing operation is conducted after fabric construction. The simple filament component contributes non-elastic stability to the fabric structure while the sheath-core filament component contributes bulk, covering power and hand.

Figure 8:
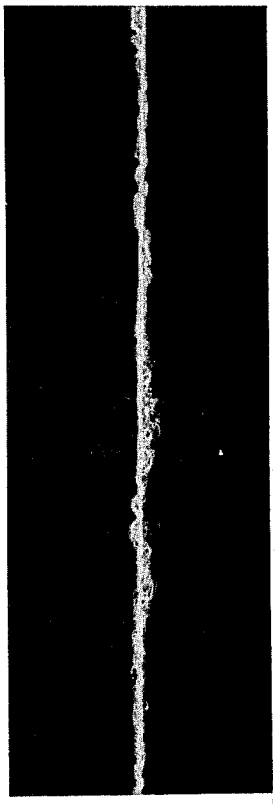
FIG. 8 is an enlarged photograph of the relaxed yarn of the present invention formed by plying, prior to the relaxing operation, a simple filament yarn and a sheath-core filament yarn, (each of the yarns of FIGS. 7 and 8 being under substantially the same tension)

FIG. 8 shows a relaxed yarn wherein a simple filament yarn and a sheath-core yarn are plied prior to relaxing.

If desired, side-by-side composite filaments may be substituted for the sheath-core filaments in the yarns described above. Such filaments may be extruded following the procedure given in U.S. Pat. No. 2,931,091. The filament-forming fluids are fed to the discharge apertures in eccentric relationship.

In the examples, the relative viscosity ($\eta_r$), i.e., viscosity of a solution of polymer relative to that of the solvent, is used as a measure of the molecular weight. The polyamide solutions contain 5.5 g. of polymer in 50 ml. of 90% formic acid and the viscosity is measured at 25° C. The polyester solutions contain 2.15 g. of the polymer in 20 ml. of a 7/10 mixture of tetrachlorophenol/phenol and the viscosity is measured at 30° C.

The thicknesses of fabrics made in the examples are measured with a dead-weight type of gauge that exerts a pressure of 3.4 pounds per square inch on the fabric (ASTM D-76-53). Due to the compressive force of the gauge, the bulk of the fabrics, are calculated from the weight per square yard and thickness is smaller than the actual bulk of the fabrics from the voluminuous yarns of this invention.

The light transmission ($I_t$) of a fabric is a measure of the covering power of a fabric and as used in the examples is the percentage of visible light passing through a 2-inch diameter sample of a fabric. The apparatus utilizes a non-collimated beam of light from a tungsten filament bulb placed 10 inches from the fabric which is 6 inches from a photocell.

EXAMPLE I

The spinneret of FIG. 1 as modified in FIG. 4 having ten orifices for spinning sheath-core filaments and five orifices for spinning simple filaments is employed in spinning a 66/6 (60/40%) nylon copolymer, poly(hexamethylene adipamide/epsilon caproamide), with a relative viscosity of 41.9 and made according to the technique of U.S. Pat. No. 2,285,009 as a sheath component of the sheath-core filaments and for the single-component or simple filaments with poly(ethylene terephthalate) of relative viscosity 19, made as described in U.S. Pat. No. 2,465,319 as the core. The polymers, at 270° C., are spun into air a 25° C. and wound up at 1,200 yards per minute. The yarn is drawn over a pin heated to 80° C. and immediately thereafter passed over a 140° C. hot plate for a total elongation of 312% of its extruded length.

Single-component filaments formed of the copolymer, when spun and drawn under the same conditions, have a boil-off shrinkage under no tension of 50%. A yarn composed of only the sheath-core filaments and drawn under the same conditions is twisted into a helical coil by the differential shrinkage of the two components in boiling water. The resulting yarn has about 40 complete turns per inch and a length of only about 30% of the yarn before boiling, (i.e., a boil-off shrinkage of about 70%).

The mixed yarn bundle as prepared above having a total denier of 30 is knitted into a tubing. Upon relaxing the tubing in 60° C. water for 5 minutes, the single-component filaments shrink, overcoming the restraining tensions of the knit construction and allowing the sheath-core filaments to become crimped. The product has a pleasing hand and is much more voluminous and exhibits more visual covering power than a similar tubing knitted from conventional continuous filament yarn of the same denier. The tubing is non-elastic.

EXAMPLE II

The polyester of Example I is replaced with the copolymer, poly(hexamethylene adipamide/terephthalamide) 65/35% by weight and a mixed bundle of filaments spun under the conditions of Example I. The yarn comprising 10 sheath-core filaments and five single-component filaments is drawn 312% over a pin at 80° C. followed by drawing over a hot plate at 140° C. to give a dense yarn of straight continuous filaments having a total denier of 30. The boil-off shrinkage of the composite filaments is 60%.

Tricot fabric is knitted from the yarn on a 21-inch tricot machine, is secured for 10 minutes at 60° C. in a one-half % aqueous sodium lauryl sulfate solution, rinsed and dried. Bulking due to crimping occurs on scouring. The resulting fabric has an extremely bulky handle. A control fabric, knitted of a continuous filament nylon yarn of 15 filaments, 2 denier per filament each, has a hard, slick hand.

Properties of the two fabrics are given below:

| ITEM | FABRIC WEIGHT OUNCES/SQ.YD. | FABRIC THICKNESS INCHES | TRANS-MISSION | FABRIC BULK $cm^3/gm$ |
|---|---|---|---|---|
| Mixed Yarn | 3.70 | 0.017 | 3.5% | 3.48 |
| Control Yarn | 2.94 | 0.010 | 11.4% | 2.85 |

The light transmission values corrected to a fabric weight of 3.0 ounces per square yard for the mixed yarn fabric and the control are 7 and 11 per cent respectively. These values exemplify the greatly increased covering power of the fabrics of the products of the present invention.

EXAMPLE III

Using the spinneret of Example I, the copolyamide poly(hexamethylene adipamide/epsilon caproamide) 80/20% by weight composition with a relative viscosity of 40, is spun as the sheath component of the sheath-core filament and as the homofilament while the copolyamide poly(hexamethylene adipamide/hexamethylene terephthalamide) 65/35% composition by weight, having a relative viscosity of 10.5 is simultaneously spun as the core of the sheath-core filaments. The polymers are spun at 270° C. into air at 25° C. and wound up at 1,000 yards per minute. The yarn is thereafter drawn 312% of its extruded length over an 80° C. pin and then wound up. Boil-off shrinkage of the composite filaments is 50% while that of the single component yarn is 25%. The final yarn having a total denier of 30 (10 composite filaments and five single-component filaments) is given one twist per inch and knitted into a tricot fabric and finished by scouring as described in the previous example.

Another sample of the drawn yarn prepared above is bulked by passing it through a 5-foot tube containing steam at atmospheric pressure at 230 yards per minute. This brief treatment effectively shrinks the single-component filaments and the composite filaments crimp, thus giving a bulky yarn. A tricot fabric is knitted from the pre-shrunk yarn to obtain a comparable fabric. The knitting with the prebulked yarn is significantly more difficult.

The properties of the two knitted fabrics are given below:

| ITEM | FABRIC WEIGHT OUNCES/YD. | FABRIC THICKNESS INCHES | FABRIC TRANS-MISSION | BULK $cm^3/gm$ |
|---|---|---|---|---|
| Mixed Yarn Bulked after fabrication | 3.07 | 0.0135 | 5.2% | 3.33 |
| Mixed Yarn Bulked before fabrication | 3.27 | 0.0135 | 5.0% | 3.13 |

The fabric from the first item above, shown in FIG. 10 has the better appearance. Both have a soft spun-yarn-like hand. The improved bulk and covering power with respect to the control fabric of Example II (which is comparable) is evident. The light transmission of the two fabrics reduced to a weight of 3.0 ounces/yard is 5.7 and 6.7% respectively. A fabric knitted from continuous filament yarn of 66 nylon is shown in FIG. 9 for comparative purposes.

EXAMPLE IV

Example III is repeated except that only 6 composite filaments and 4 homofilaments are wound up. After processing as previously described, this yarn is fabricated into a tricot fabric. The final yarn has a total denier of 30. A control is knitted under conditions to yield a comparable finished fabric of a continuous filament 66 nylon yarn of 13 filaments with a total denier of 40. Fabric properties are listed below:

| ITEM | FABRIC WEIGHT OUNCES/YD. | FABRIC THICKNESS INCHES | TRANS-MISSION | FABRIC BULK $cm^3/gm$ |
|---|---|---|---|---|
| Mixed Yarns | 2.94 | 0.0135 | 7.2% | 3.46 |
| Control item | 2.93 | 0.0105 | 13.2% | 2.68 |

The transmission of the two fabrics reduced to a 3.0 ounces per square yard basis is 6.9 and 12.7% respectively. The superiority of the fabric knitted from the yarn of the present invention is apparent. It has a much softer hand, and more voluminosity and covering power than the control fabric which possesses the typical slick and hard hand of a synthetic continuous filament fabric.

EXAMPLE V

The spinneret of Example I is modified to produce fifteen filaments of sheath-core yarn which is spun and drawn as taught in Example I to give a total denier of 30. Using another spinneret, a bundle of 10 simple or single-component filaments of the 66/6 nylon copolymer are spun and similarly treated to give a total denier of 30. The sheath-core and simple filaments are then plied with a light twist.

Two ends of the drawn but unbulked yarn of Example I are plied together to give a 30 filament yarn with a total denier of 60.

Each of the mixed yarns prepared as described above is bulked by placing it in 80° C. water for 5 minutes. Each yarn gives a voluminous product with a soft spun handle, much superior to the continuous filament yarns of 66 nylon. The yarn obtained by spinning is shown in FIG. 7, while that obtained by plying is shown in FIG. 8. Because of its less dense and more uniform nature, the yarn of FIG. 7 is preferred.

EXAMPLE VI

Using the polymers and processing conditions of Example III, a bundle of 34 filaments (17 single-component filaments and 17 sheath-core filaments) are spun and thereafter drawn 336% of the extruded length at 40° C., to a total denier of 68. The yarn is bulked by passing it through a 5-foot steam tube at atmospheric pressure at a speed of 230 yards per minute.

This yarn is then woven into a fabric with a basket weave (3 ends of warp × 2 picks) to yield a scoured and finished fabric with a count of 168 wrap ends per inch and 119 pick counts per inch. A comparative control fabric is produced from continuous nylon filaments. The properties of these fabrics are reported below:

| ITEM | FABRIC WEIGHT OUNCES/SQ.YD. | FABRIC THICKNESS INCHES | FABRIC BULK $cm^3/gm$ |
|---|---|---|---|
| Mixed yarn | 3.1 | 0.011 | 2.63 |
| Control | 2.4 | 0.008 | 2.40 |

The comparative control is very lustrous and feels slippery and slick to the hand. The fabric of mixed filaments has a subdued luster, a soft hand, significantly greater bulk and a higher covering power than the control.

EXAMPLE VII

The copolymer of Example I is extruded to form five single component filaments and is also extruded in side-by-side relationship with poly(hexamethylene adipamide), 66 nylon, having a relative viscosity of 40 to form ten two-component filaments. A spinneret of the type shown in FIG. 6 is modified so that copolymer from cistern 3 is extruded in side-by-side relationship with 66 polymer from cistern 4, the polymer flow being as illustrated in FIG. 6 of U.S. Pat. NO. 2,931,091. The single component filaments are extruded from copolymer supplied by cistern 20 as shown in FIG. 6. The yarn is processed as described in Example I. When the yarn, having a total denier of 30, is knit into a tubing and the tubing placed in 60° C. water in a relaxed state for 5 minutes, the results are similar to those described in the product of Example I.

The production of the products of this invention have been illustrated by the spinning of self-crimpable composite filaments and high shrinking single-component filaments from the same spinneret and also by the plying of the composite filaments and the high-shrinking filaments that were spun separately. The product obtained by plying presents a route to a new class of bulky continuous filament yarn superior to the products of the prior art. However, the co-spinning method from the same spinneret is a preferred process and yields a superior product due to the better mixing of the filaments in the co-spinning process, producing a more voluminous product with a greater covering power and a more pleasing soft spunyarn-like hand. Of equal importance is the fact that plying of low denier yarns, for example 15 filaments of 2–3 denier per filament is quite difficult, time consuming and expensive, due to the small size of the yarn. The problem is intensified when yarns containing 5 to 10 filaments of 2 denier per filament or lower must be plied to obtain a low count yarn for such applications as tricot knitting, for example. The co-spinning process affords a continuous, relatively inexpensive means of making the improved products of this invention.

Although this invention has been illustrated with mixed yarns in which the single-component filaments and the sheath of the composite filaments are made of the same polymer, it will be obvious to those skilled in the art that the sheath and the high-shrinking component need not be the same polymer. FIG. 6 represents one possible means of doing this using an inner reservoir 21 with an independent cistern 20 so that three different polymers can be spun from this spinneret.

The composite filaments have been produced in the examples by the melt-spinning technique. Any other spinning method such as "plasticized" melt spinning, dry spinning, wet spinning, can be employed successfully as well. In some instances, the various co-spun yarns may be produced by different spinning methods, i.e., a melt spinning system may be combined with a dry spinning system employing the filament forming spinning assembly as described herein. Thus, for instance, one component, preferably the component forming the sheath can be spun as a solution in a high-boiling solvent or as a plasticized melt, while the core-forming component is extruded as the molten polymer. In these instances, the solvent or plasticizers may be wholly or partially removed subsequently, preferably by washing them out by the help of low-boiling solvents.

The self-crimpable or composite filaments used in the mixed yarns of this invention and so called because of their spontaneous crimpability on relaxation without the necessity of a mechanical crimping operation, are composed of two polymers such that after drawing, the two components have different degrees of shrinkage so that a helically-crimped filament is obtained upon shrinking in hot water, boiling water, steam, etc. The two components may be formed into the filament in the form of a sheath and a core, or they may be in the form of a side-by-side filament in which the two components touch each other along the entire length of the filament. Products of this type are illustrated in Example VII and in U.S. Pat. application Ser. No. 412,781, now U.S. Pat. No. 2,931,091. Suitable pairs of components for use in the composite filaments can be found in all groups of synthetic fiber-forming materials, which are filament-forming and which, in addition, possess sufficient difference in potential shrinkage between the two selected components to produce a crimped fiber. The minimum difference in potential shrinkage in the composite filament is preferably at least about 2%. The shrinkage may be developed by any known method, such as, for instance, as disclosed in the above-mentioned copending application.

Because of their commercial availability, ease of processing and excellent properties, the condensation polymers and copolymers, e.g., polyamides, polysulfonamides and polyesters and particularly those that can be readily melt spun, are preferred. Suitable polymers can be found, for instance, among the fiber-forming polyamides and polyesters which are described in U.S. Pat. Nos. 2,071,250, 2,071,253, 2,130,523, 2,130,948, 2,190,770 and 2,465,319. The preferred group of polyamides comprises such polymers as poly(hexamethylene adipamide), poly(hexamethylene sebacamide), poly(epsiloncaproamide) and the copolymers thereof. Among the polyesters that may be mentioned, besides poly(ethylene terepthalate), are the corresponding copolymers containing sebacic acid, adipic acid, isophthalic acid, as well as the polyesters containing recurring units derived from glycols with more than two carbons in the chain.

The low shrinking component of the composite filament is preferably a low molecular weight polymer that has 75% or less of the molecular weight that would be used for commercial spinning of filaments composed entirely of the polymer in question. A preferred class of polymers for use as the lower shrinking member of the composite filaments are those condensation polymers containing an aromatic group intralinear to the polymer chain. These include polyamides and polyesters made from such monomers as: terephthalic acid, isophthalic acid, p-xylylene diamine, p-bis(p-aminoethyl)benzene, p-phenylene diamine, 4,4′-diaminodiphenylmethane in conjunction with other comonomers as desired.

The composite filaments (i.e., filaments composed of at least two different fiber-forming man-made polymers having potential shrinkage differential of at least about 2% and being joined along their longitudinal axes) employed in the production of yarns of the present invention are preferably those which, on relaxed shrinking, will decrease at least about 15% of their uncrimped length and preferably 30 to 70%.

The single-component filaments preferably display a greater decrease in length upon shrinking than the composite filaments (i.e. length after crimps are pulled out) so that the single-component filaments act as the stress-bearing member and the optimum crimp and resultant bulk of the yarn can be developed. Suitable polymers for the single filaments can be found in all classes of polymers and will be obvious to those skilled in the art. In general, copolyamides are suitable for forming the high-shrinking filaments such as poly(hexamethylene adipamide/epsilon caprolactam), poly(hexamethylene adipamide/sebacamidel), and poly(hexamethylene adipamide/sebacamide/epsilon caproamide) and others. Copolyesters and esters such as poly(ethylene terephthalate/isophthalate), the copolymer from dimethyl terephthalate and poly(ethylene oxide)glycol and others are also quite suitable. Preferably, the single-component filaments should be capable of exerting their shrinkage against the tensions employed in fabric formation which, for example, in plain knitwear may be in the order of 0.00065 gram per denier and in selecting the components, the shrinkage should be measured under some slight tension. The above-mentioned polymers are satisfactory for the co-spinning process where they will develop sufficient shrinkage upon a small amount of drawing such as 200 to 400% and using usual spinning conditions. However, if the yarns of this invention are made by plying, then no such limits on the spinning and drawing processes are present. More than one type of single-component filament may be present in the yarn bundle as the stress bearing member, provided the various types possess essentially the same shrinkage characteristics.

Fibers of such materials as poly(ethylene terephthalate) can be processed under conditions such that they have a high residual shrinkage, for example, see U.S. Pat. No. 2,604,689, issued to Hebeler on July 29, 1952. The patent art in the textile fibers field is crowded with proposed means of stabilizing the lengths of drawn fibers. Such fibers that are not stabilized may have the high shrinkages preferred for use in this invention, for example, see U.S. Pat. No. 2,517,570, which speaks of the stabilization of vinylidene chloride polymer particles and British Pat. No. 610,184 which speaks of the stabilization of aromatic linear polyester articles.

The mixed yarns of this invention in a nonbulked condition are of great utility in the fabrication of textiles and especially tricot knitwear, where the bulk of the fabric can be developed after weaving or knitting. The yarns are of great advantage in the packaging, shipping and processing in the relatively dense conditions. After bulking, the yarns of this invention confer a soft spun-like hand to fabrics with excellent bulk and covering power.

As described above in its broad aspect, the present invention provides a yarn mixture of a self-crimpable or composite member and a stress bearing single component filament. Such a yarn may be produced by a process of plying the component members but is preferably formed by co-spinning as taught herein. In its relaxed state the yarn of the present invention acquires a crimped characteristic giving it high bulk and high covering power when used in fabric construction without loss of structural rigidity. Preferably the fabric is constructed by conventional means such as knitting or weaving prior to the relaxation operation.

In some instances, where side-by-side, self-crimpable filaments are prepared from highly dissimilar polymers, the component making up the filaments may tend to separate during fabric finishing. Such separation is, however, not necessarily a disadvantage but may actually lead to improved fabric aesthetics if an approximate fabric finishing procedure is employed.

Many obvious modifications will be apparent to those skilled in the art without a deparature from the concept of the present invention.

I claim:

1. An improved bulky substantially non-elastic yarn for use under certain given conditions, said yarn comprising, in combination, a plurality of substantially straight continuous filaments of a first polymeric composition having low extensibility under said conditions, and a plurality of helically crimped continuous composite sheath-core type filaments of greater length than said straight filaments, co-spun from a common spinneret with said plurality of straight filaments and evenly mixed with filaments of said first plurality, each of said composite filaments comprising a first longitudinally extending component of a second polymeric composition having an extensibility under said given conditions significantly greater than said filaments of said first composition, each of said composite filaments further comprising a second longitudinally extending component in engagement with said first component and of a third polymeric composition, and straight filaments of low extensibility providing stress-bearing stretch-resistant properties to the yarn sufficient to resist a stress of 0.00065 gram per denier on the yarn and cooperating with said crimped composite filaments to produce in said yarn increased bulk, covering power, and resistance to stretch.

2. An improved compact straight yarn adapted for simple conversion to a bulked non-elastic yarn, said yarn comprising, in combination, a first plurality of continuous filaments of a first polymeric composition having high shrinkage characteristics under given conditions, and a second plurality of continuous sheath-core type composite filaments evenly mixed and co-spun from a common spinneret with said first plurality of filaments and of substantially equal length to said filaments of said first plurality, each of said composite filaments comprising a first longitudinally extending component of a second polymeric composition having shrinkage characteristics significantly lower than filaments of said first composition under said given conditions, each of said composite filaments further comprising a second longitudinally extending component in engagement with said first component and of a third polymeric composition, the characteristics of said compositions so selected and the physical relationship of said components of said composite filaments such that upon subjecting the yarn to said given conditions the second plurality of filaments assumes a helically crimped configuration to give increased bulk and covering power to said yarn and said first plurality of filaments attains a shortened length and modified properties to become a non-elastic stretch-resistant load bearing element having sufficient tensile strength to successfully resist a stress of 0.00065 gram per denier on the element.

3. An improved compact straight yarn adapted for simple conversion to a crimped non-elastic yarn, said yarn comprising, in combination, a first plurality of continuous filaments of a first polymeric composition having high shrinkage characteristics under given conditions, and a second plurality of continuous sheath-core type composite filaments simultaneously co-spun from a common spinneret and mixed with said first plurality of filaments and of substantially equal length with said filaments of said first plurality, each of said composite filaments comprising a first longitudinally extending component of a second polymeric composition having shrinkage characteristics significantly lower than the composition of said first plurality of filaments under said given conditions, each of said composite filaments further comprising a second longitudinally extending component of said first polymeric composition, the characteristics of said compositions so selected and the physical relationship of said components of said composite filaments such that upon subjecting the yarn to said given conditions the second plurality of filaments assumes a helically crimped configuration to give increased bulk and covering power to said yarn and said first plurality of filaments attains a shortened length and modified properties to become substantially a non-elastic stretch-resistant load-bearing element.

4. The yarn of claim 3 wherein said first plurality of filaments have a shrinkage of at least 15% when treated with boiling water.

5. The yarn of claim 4 wherein said composite filaments are comprised of two components having a shrinkage differential of at least about 2%.

6. The yarn of claim 5 wherein said first polymeric composition is a linear polyamide.

7. The yarn of claim 6 wherein said first plurality of filaments have shrinkage forces capable of overcoming restraining forces of about 0.00065 gram per denier.

8. A bulked dimensionally stable singles yarn composed of a plurality of continuous filaments, certain of said continuous filaments being uniformly crimped throughout at least a portion of their length to provide bulk and others of said continuous filaments being in relatively straight form to provide dimensional stability, said crimped and straight filaments being randomly disposed throughout the cross-section of said yarn.

9. A bulked dimensionally stable singles yarn composed of a plurality of continuous filaments, certain of said continuous filaments being uniformly crimped throughout substantially their entire length to provide bulk and others of said continuous filaments being in relatively straight form to provide dimensional stability, said crimped and straight filaments being randomly disposed throughout the cross-section of said yarn.

10. A bulked dimensionally stable singles yarn consisting of a plurality of continuous filaments, certain of said filaments being uniformly crimped throughout substantially their entire length to provide bulk, others of said filaments being substantially straight throughout their entire length to provide dimensional stability, said filaments being twisted into the form of a twisted singles yarn, said crimped filaments being randomly disposed throughout at least a substantial portion of the cross-sectional area of said yarn.

* * * * *

UNITED STATES PATENT OFFICE

CERTIFICATE OF CORRECTION

PATENT NO. : 3,988,883

DATED : November 2, 1976

INVENTOR(S) : Benjamin Chiatse Sze

It is certified that error appears in the above-identified patent and that said Letters Patent are hereby corrected as shown below:

Claim 1, column 11, line 13, delete "and" and insert --said--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*